US008827423B2

(12) United States Patent
Nakao

(10) Patent No.: US 8,827,423 B2
(45) Date of Patent: Sep. 9, 2014

(54) LIQUID EJECTING HEAD AND LIQUID EJECTING APPARATUS

(71) Applicant: Seiko Epson Corporation, Tokyo (JP)

(72) Inventor: Hajime Nakao, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/031,109

(22) Filed: Sep. 19, 2013

(65) Prior Publication Data

US 2014/0085382 A1 Mar. 27, 2014

(30) Foreign Application Priority Data

Sep. 26, 2012 (JP) ..... 2012-211857

(51) Int. Cl.
*B41J 2/14* (2006.01)
*B41J 2/15* (2006.01)

(52) U.S. Cl.
CPC *B41J 2/1433* (2013.01); *B41J 2/15* (2013.01); *B41J 2/14274* (2013.01); *B41J 2202/11* (2013.01); *B41J 2002/14419* (2013.01); *B41J 2002/14362* (2013.01)
USPC ..... 347/47

(58) Field of Classification Search
CPC ..... B41J 2002/14306; B41J 2/1433; B41J 2/14032
USPC ..... 347/47
See application file for complete search history.

(56) References Cited

U.S. PATENT DOCUMENTS 4,905,017 A * 2/1990 Sugitani et al. ..... 347/65
7,984,980 B2 * 7/2011 Kachi ..... 347/86

FOREIGN PATENT DOCUMENTS

JP 11-309877 11/1999
JP 2005-034998 2/2005

* cited by examiner

*Primary Examiner* — Alessandro Amari
*Assistant Examiner* — Michael Konczal

(57) ABSTRACT

A liquid ejecting head includes: a nozzle plate in which a first nozzle row of nozzle openings aligned along a first direction X and a second nozzle row of nozzle openings aligned along the first direction X are disposed side by side along a second direction Y perpendicular to the first direction X; and a channel member including pressure generating chambers aligned along the first direction X, supply paths that supply liquid to the pressure generating chambers, and nozzle communication holes that allows the pressure generating chambers and the nozzle openings to communicate with each other, wherein the supply paths are located at an identical position in the second direction Y and are aligned along the first direction X, the nozzle communication holes include first openings communicating with the pressure generating chambers and second openings open to the nozzle plate.

4 Claims, 9 Drawing Sheets

LIQUID EJECTING HEAD AND LIQUID EJECTING APPARATUS

BACKGROUND

1. Technical Field

The present invention relates to a liquid ejecting head and liquid ejecting apparatus that eject liquid through nozzle openings, and particularly to an ink jet print head and ink jet print apparatus that discharge ink as liquid.

2. Related Art

A typical liquid ejecting head is, for example, an ink jet print head that discharges ink droplets through nozzle openings by causing a pressure change of ink in pressure generating chambers communicating with the nozzle openings.

To arrange nozzle openings densely, such an ink jet print head has a so-called staggered pattern where first nozzle rows, in each of which nozzle openings are aligned along a first direction, and second nozzle rows, in each of which nozzle openings are aligned along the first direction, are arranged side by side along a second direction, which intersects with the first direction, and are shifted from each other in the first direction such that the first nozzle rows do not coincide with the second nozzle rows when viewed in the second direction (see, for example, JP-A-11-309877).

However, as described in JP-A-11-309877, the use of only the staggered pattern where the first nozzle rows and the second nozzle rows shift from each other along the first direction has a limitation in reducing the pitch between the nozzles in the first direction for an increased density in order to obtain dimensions of channels and partitions necessary for forming individual channels.

Similar problems are found not only in ink jet print heads but also in liquid ejecting heads that eject liquid other than ink.

SUMMARY

An advantage of some aspects of the invention is that a liquid ejecting head and liquid ejecting apparatus can achieve densely arranged nozzle openings and size reduction thereof.

According to an aspect of the invention, a liquid ejecting head includes: a nozzle plate in which a first nozzle row of nozzle openings aligned along a first direction and a second nozzle row of nozzle openings aligned along the first direction are disposed side by side along a second direction perpendicular to the first direction, the nozzle openings of the first nozzle row and the nozzle openings of the second nozzle row being located at different positions in the first direction; and a channel member including pressure generating chambers aligned along the first direction, supply paths that supply liquid to the pressure generating chambers, and nozzle communication holes that allows the pressure generating chambers and the nozzle openings to communicate with each other, wherein the supply paths are located at an identical position in the second direction and are aligned along the first direction, the nozzle communication holes include first openings communicating with the pressure generating chambers and second openings open to the nozzle plate, the first openings are located at an identical position in the second direction and are aligned along the first direction, the second openings have a width in the first direction larger than that of the pressure generating chambers, the second openings aligned along the first direction alternately communicate with the first nozzle row and the second nozzle row, and the second openings are alternately arranged on different sides with respect to the first openings when viewed in the second direction.

In this aspect, the width in the first direction of the second opening is larger than that of the pressure generating chamber, thereby facilitating positioning between the nozzle communication holes and the nozzle openings to reduce problems due to displacement between the nozzle openings and the nozzle communication holes. In addition, an alternating shift of the second openings of the nozzle communication holes along the second direction enables the nozzle communication holes to be closely arranged along the second direction, thereby densely arranging the nozzle openings along the second direction and achieving size reduction. In addition, since the supply paths are aligned along the first direction and located at the identical position in the second direction, a variation of supply characteristics in supplying liquid to the pressure generating chambers can be reduced, thereby uniformizing discharge characteristics of droplets.

It is preferable that the second openings communicating with the first nozzle row are located at positions closer to supply paths located on the side of the pressure generating chambers than the first openings in the second direction, the second openings communicating with the second nozzle row are located at positions farther from the supply paths located on the side of the pressure generating chambers than the first openings in the second direction, and all the nozzle communication holes have constant volume and constant distance from the first openings to the second openings. In this case, the distance (the channel length) and the volume from the pressure generating chambers to the nozzle openings are uniform, thereby uniformizing discharge characteristics of droplets discharged from the nozzle openings.

According to another aspect of the invention, a liquid ejecting apparatus includes the liquid ejecting head of the aspect described above.

In this aspect, droplets of high number density can be ejected to an ejection target, and the size of the liquid ejecting apparatus can be reduced.

BRIEF DESCRIPTION OF THE DRAWINGS

The aspect of the invention will be described with reference to the accompanying drawings, wherein like numbers reference like elements.

DESCRIPTION OF EXEMPLARY EMBODIMENTS

The aspect of the invention will be described in detail hereinafter with reference to embodiments.

First Embodiment

Figure 1:
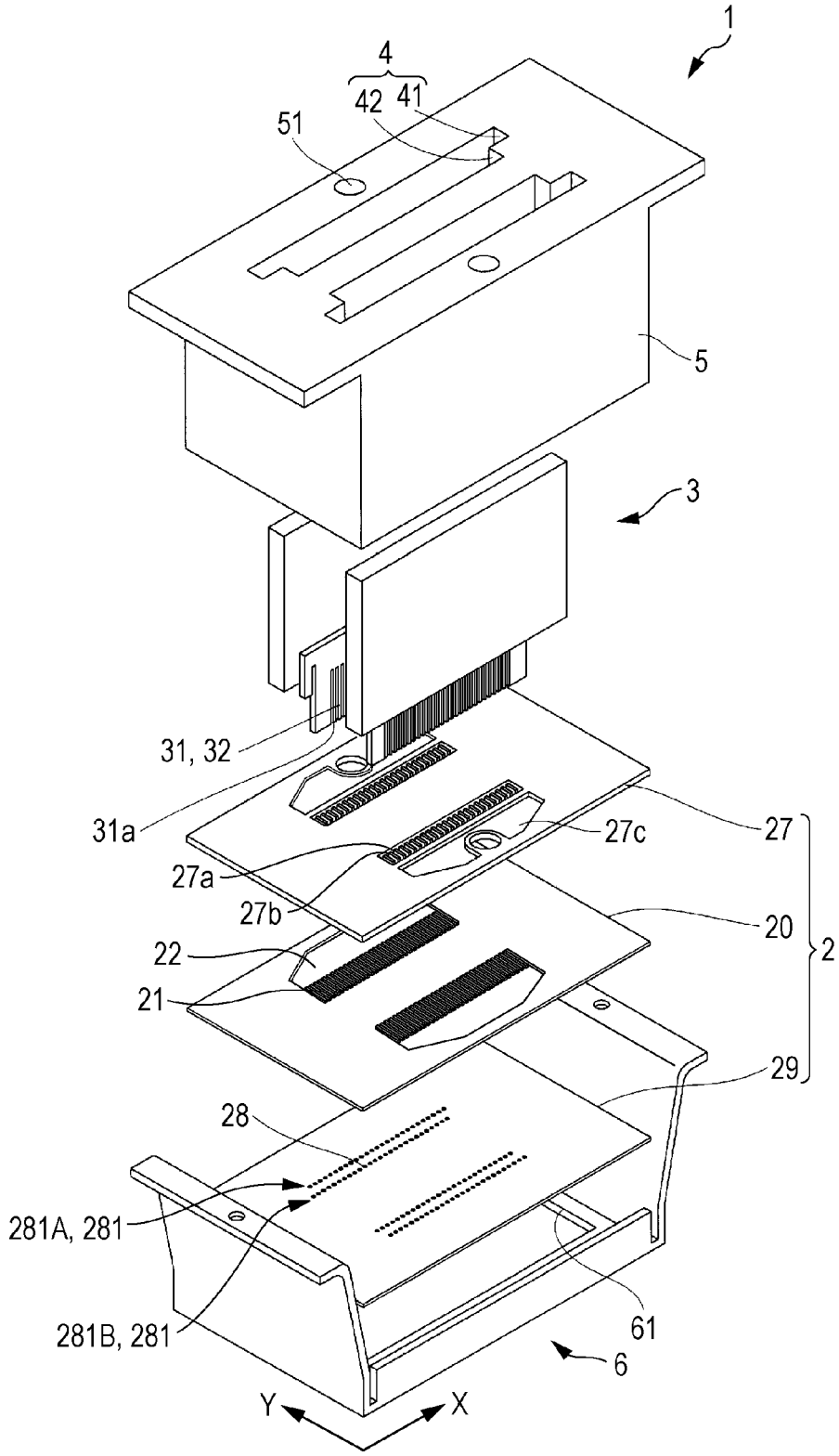
FIG. 1 is an exploded perspective view of a print head according to a first embodiment of the invention.
Figure 2:
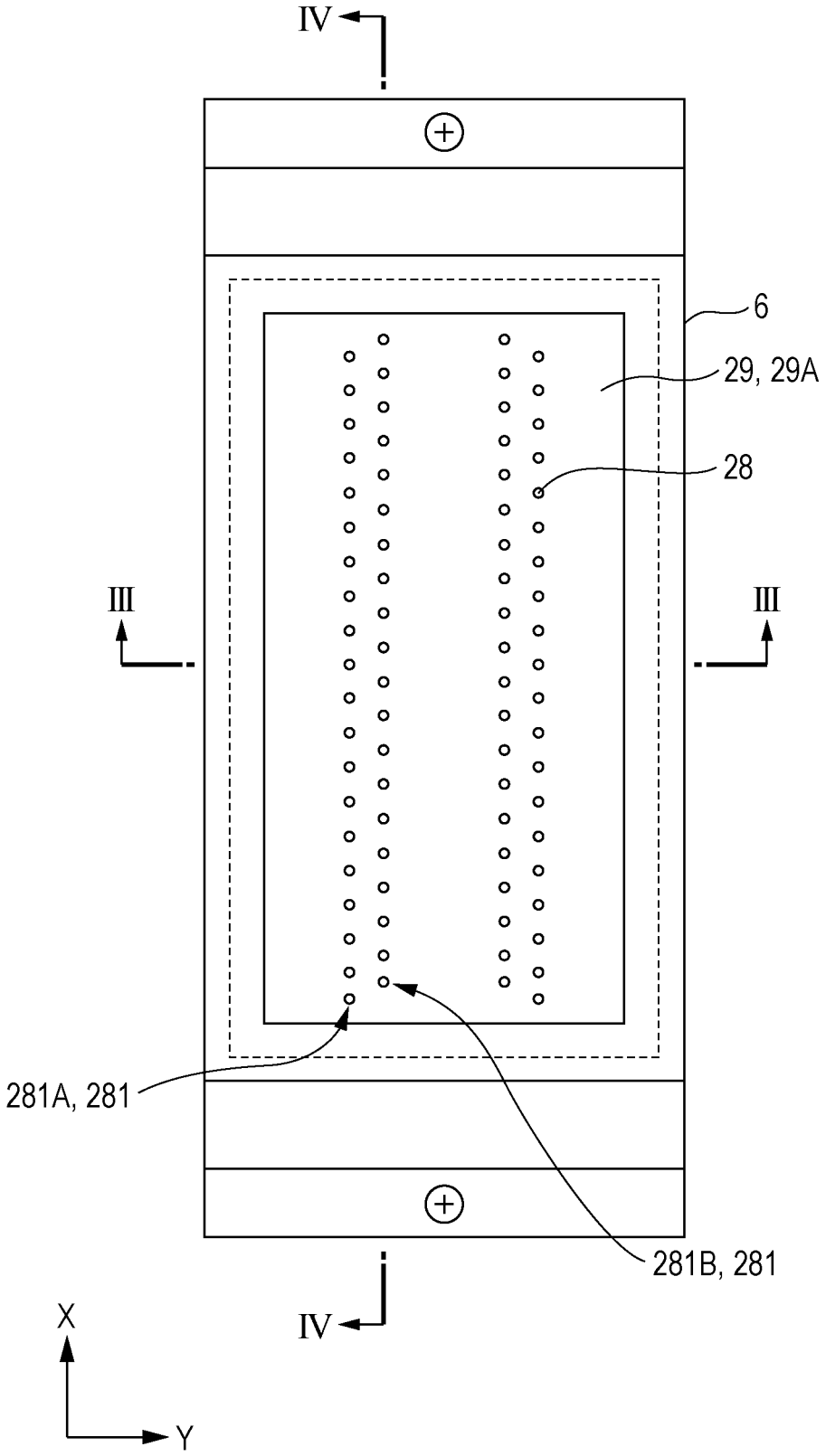
FIG. 2 is a plan view of the print head of the first embodiment.
Figure 3:
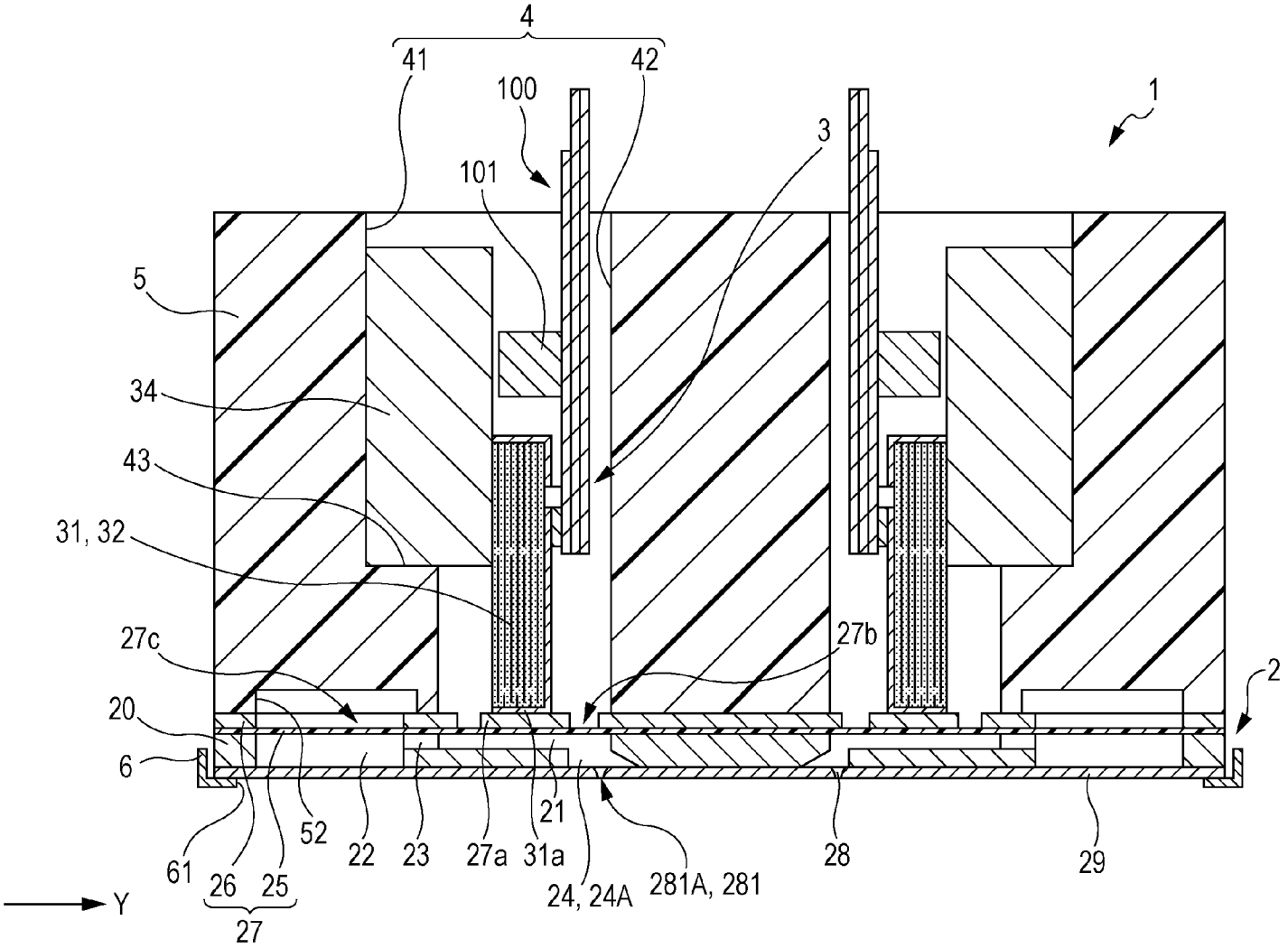
FIG. 3 is a cross sectional view of the print head of the first embodiment.
Figure 4:
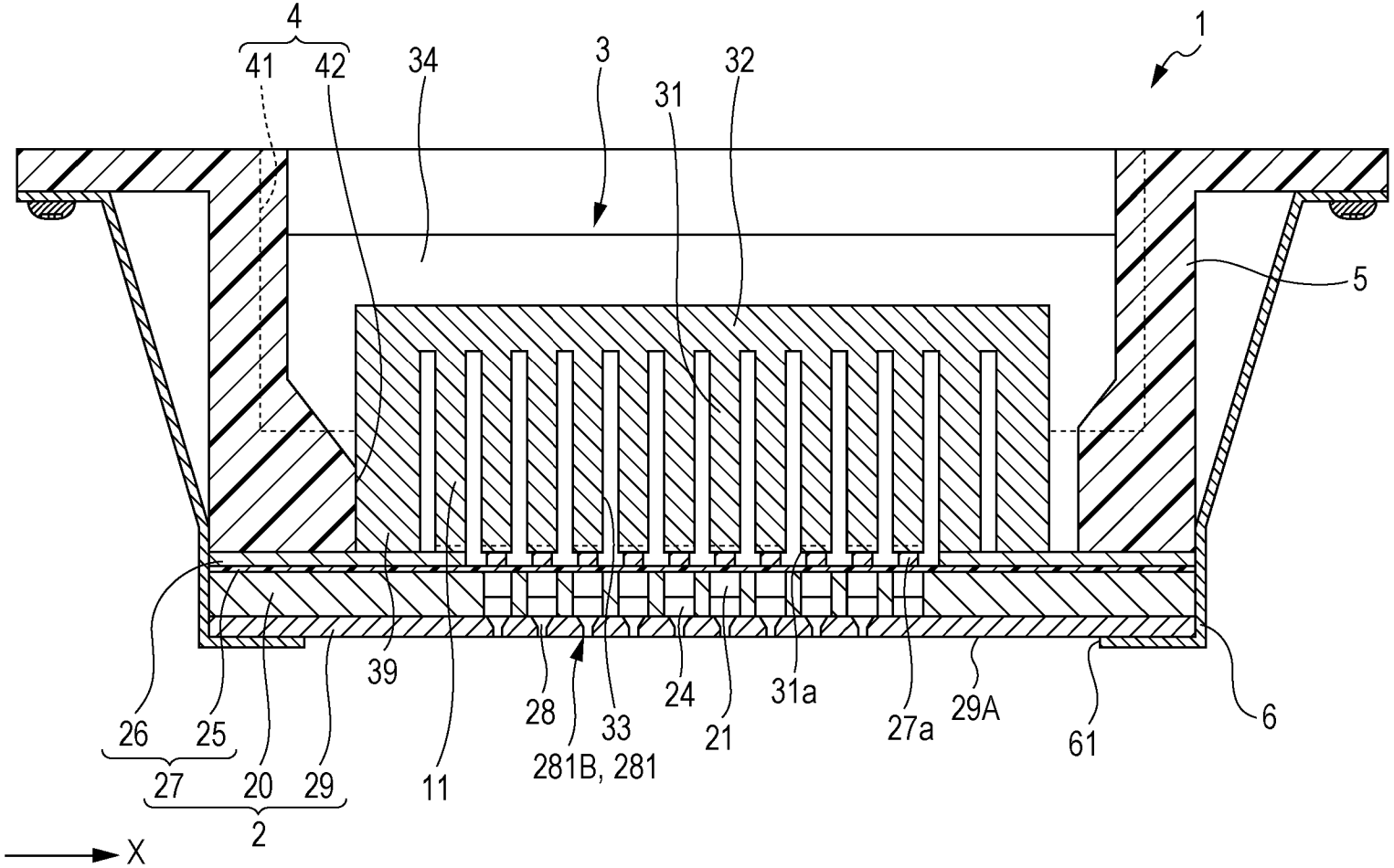
FIG. 4 is a cross sectional view of the print head of the first embodiment.

FIG. 1 is an exploded perspective view of an ink jet print head that is an example of a print head according to a first embodiment of the invention. FIG. 2 is a plan view of a liquid ejecting surface of the ink jet print head. FIG. 3 illustrates a cross section taken along line III-III in FIG. 2. FIG. 4 illustrates a cross section taken along line IV-IV in FIG. 2.

As illustrated in the drawings, an ink jet print head 1 (hereinafter also referred to as a print head 1), which is an example of the liquid ejecting head of this embodiment, includes a channel unit 2, a pair of actuator units 3 fixed to the channel unit 2, a case 5 fixed to the channel unit 2 and including housings 4 capable of housing the actuator units 3 therein, and a cover 6 covering the surface of the channel unit 2 opposite to the surface of the channel unit 2 to which the actuator units 3 are fixed.

The channel unit 2 includes a channel substrate 20, which is a channel member of this embodiment, a vibrating board 27, and a nozzle plate 29.

The nozzle plate 29 is, for example, a plate member made of a metal such as stainless steel, a semiconductor such as silicon, or a ceramic material. In the nozzle plate 29, a plurality of (four in this embodiment) nozzle rows 281, in each of which nozzle openings 28 are aligned along a first direction X, are arranged side by side along a second direction Y perpendicular to the first direction X. In this embodiment, a first nozzle row 281A of the nozzle openings 28 aligned along the first direction X and a second nozzle row 281B of the nozzle openings 28 aligned along the first direction X are provided for a single row of pressure generating chambers 21 aligned along the first direction X, which will be described later. The first nozzle row 281A and the second nozzle row 281B are disposed side by side along the second direction Y. Here, each of the nozzle openings 28 constituting the second nozzle row 281B is located between associated ones of the nozzle openings 28 constituting the first nozzle row 281A in the first direction X. On the other hand, each of the nozzle openings 28 constituting the first nozzle row 281A is located between associated ones of the nozzle openings 28 constituting the second nozzle row 281B in the first direction X. That is, the nozzle openings 28 of the first nozzle row 281A and the nozzle openings 28 of the second nozzle row 281B are alternately arranged in the first direction X to form a so-called staggered pattern.

The pitch of (the distance between) the nozzle openings 28 that are adjacent to each other along the first direction X in the first nozzle row 281A is equal to the pitch of (the distance between) the nozzle openings 28 that are adjacent to each other along the first direction X in the second nozzle row 281B. The nozzle openings 28 of the second nozzle row 281B are shifted by a half of the pitch in the first direction X from the nozzle openings 28 of the first nozzle row 281A. In other words, the nozzle openings 28 of the first nozzle row 281A and the nozzle openings 28 of the second nozzle row 281B are arranged at a half of the pitch of the nozzle openings 28 of the first nozzle row 281A in the first direction X. Thus, the first nozzle row 281A and the second nozzle row 281B can achieve a density twice as high as that in a configuration including only the first nozzle row 281A.

In this embodiment, two rows of the pressure generating chambers 21 are provided, which will be specifically described later, and accordingly, two pairs of the first nozzle rows 281A and the second nozzle rows 281B are provided.

The pressure generating chambers 21 defined by partitions are aligned along the first direction X in a surface portion at a surface of the channel substrate 20. The channel substrate 20 is provided with a plurality of rows, two rows in this embodiment, of the pressure generating chambers 21 aligned along the first direction X.

A manifold 22 to which ink is supplied through an ink passage (not shown), serving as a liquid passage of the case 5, is provided on the outer side of each of the rows of the pressure generating chambers 21, and penetrates the channel substrate 20 along the thickness direction thereof. The manifold 22 communicates with the pressure generating chambers 21 through supply paths 23 located on one side in the second direction Y of the pressure generating chambers 21. Ink is supplied to the pressure generating chambers 21 through the ink passage (not shown), the manifold 22, and the supply paths 23.

In this embodiment, the supply path 23 has a width (a width in the first direction X) smaller than that of the pressure generating chambers 21, and maintains a constant channel resistance of ink flowing from the manifold 22 into the pressure generating chambers 21.

In this embodiment, the supply paths 23 are aligned along the first direction X such that the supply paths 23 are located at the same position in the second direction Y and have a constant distance and a constant volume from the manifold 22 to the pressure generating chambers 21. This configuration can obtain uniform supply characteristics in supplying ink from the manifold 22 through the supply paths 23 to the pressure generating chambers 21.

In this embodiment, the pressure generating chambers 21 aligned along the first direction X communicate with the same manifold 22 through the supply paths 23, and are charged with ink of the same color supplied to the manifold 22. That is, two manifolds 22 are provided in this embodiment, and each of the manifolds 22 communicates with a row (i.e., a row extending along the first direction X) of the pressure generating chambers 21. Accordingly, two colors of ink are discharged from one ink jet print head 1. If the same color ink is supplied to the two manifolds 22, the same color ink is supplied to the two rows of the pressure generating chambers 21, and the same color ink is discharged from the four nozzle rows 281.

In addition, in the channel substrate 20, nozzle communication holes 24 are provided on another side in the second direction Y of the pressure generating chambers 21 opposite to the manifold 22, and penetrate the channel substrate 20 along the thickness direction thereof (i.e., the direction along which the channel substrate 20 and the nozzle plate 29 are stacked).

Figure 5:
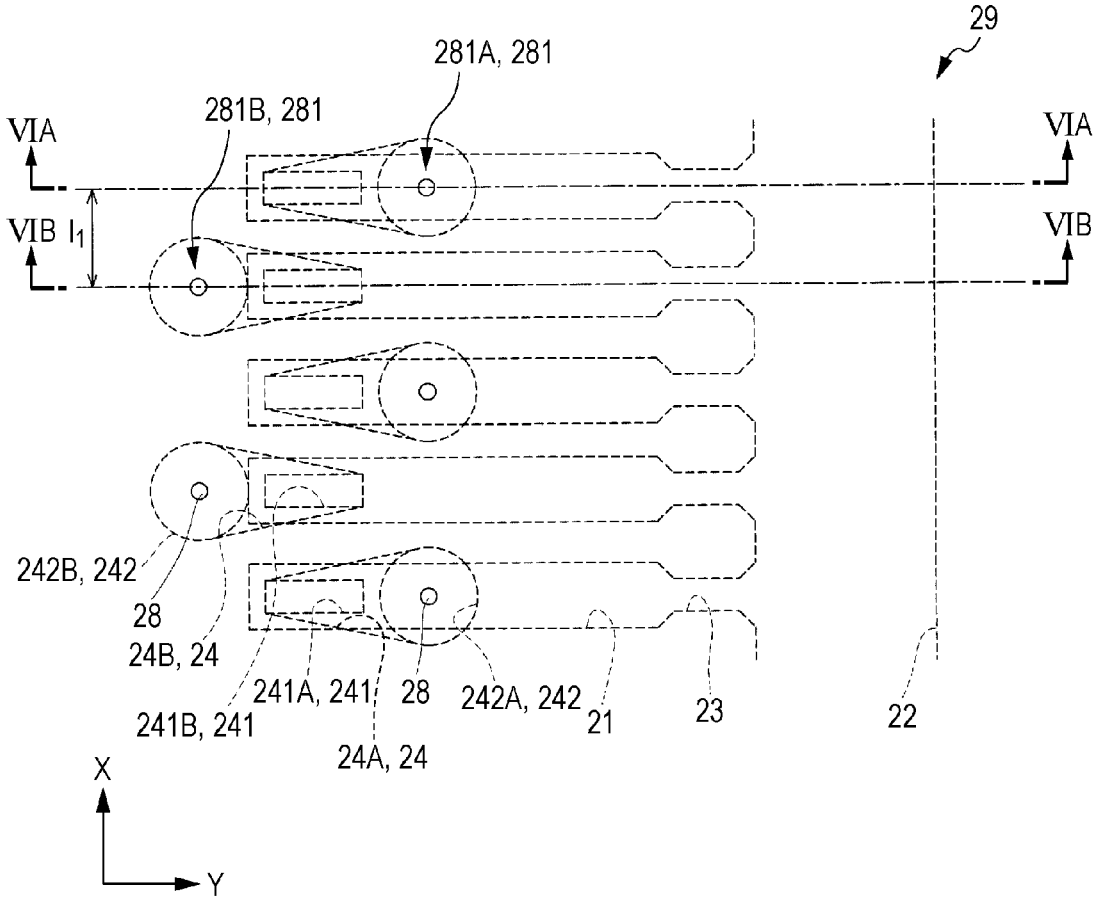
FIG. 5 is an enlarged plan view of a main portion of the print head of the first embodiment.
Figure 6A:
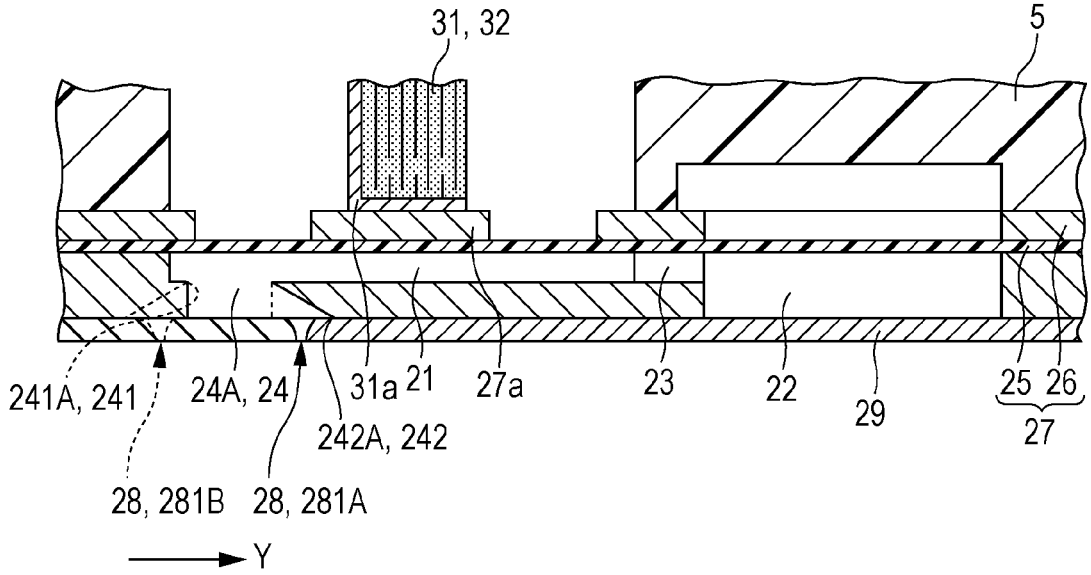
FIG. 6A is an enlarged cross sectional view of a main portion of the print head of the first embodiment.
Figure 6B:
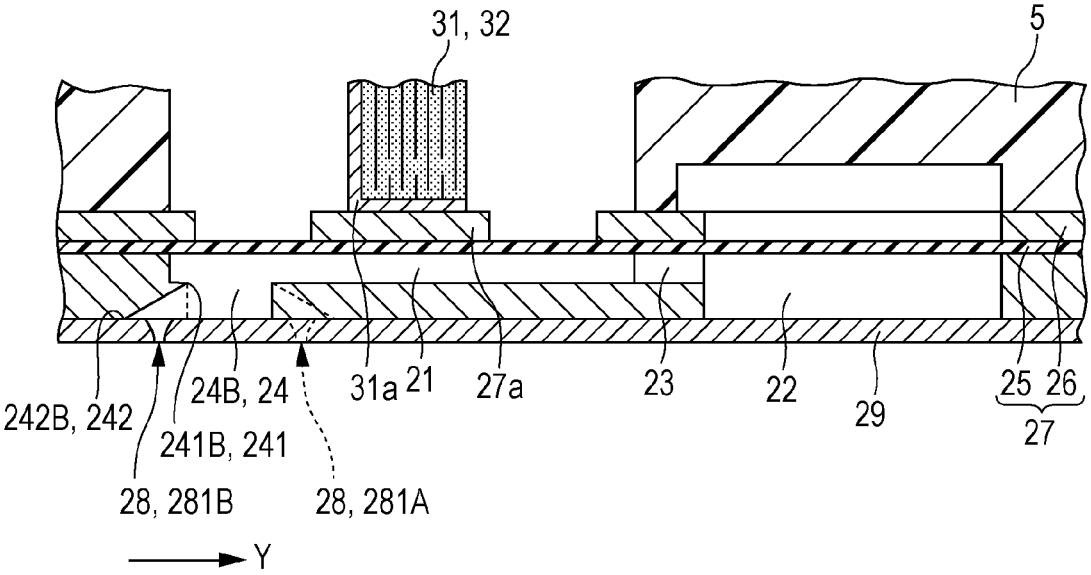
FIG. 6B is an enlarged cross sectional view of a main portion of the print head of the first embodiment.

Referring now to FIGS. 5, 6A, and 6B, the nozzle communication holes 24 will be specifically described. FIG. 5 is an enlarged plan view illustrating a main portion of the ink jet print head when viewed from a liquid ejecting surface. FIGS. 6A and 6B illustrate cross sections taken along line VIA-VIA and line VIB-VIB, respectively, in FIG. 5.

As illustrated in FIGS. 5, 6A, and 6B, each of the nozzle communication holes 24 of this embodiment includes a first nozzle communication hole 24A and a second nozzle communication hole 24B having different shapes.

The nozzle communication holes 24 include first openings 241 communicating with the pressure generating chambers 21 and second openings 242 communicating with the nozzle openings 28. In this embodiment, it is defined that the first nozzle communication holes 24A have the first openings 241A and the second openings 242A, and the second nozzle communication holes 24B have the first openings 241B and the second openings 242B. The first openings 241 will be hereinafter referred to as a generic term including the first openings 241A and the first openings 241B, and the second openings 242 will be hereinafter referred to as a generic term including the second openings 242A and the second openings 242B.

The first openings 241 are wider than the width, in the first direction X, of the pressure generating chambers 21, and the first openings 241 are open at the bottoms of the pressure generating chambers 21, e.g., at the sides of the pressure generating chambers 21 facing the nozzle plate 29.

The second openings 242 are wider than the width, in the first direction X, of the pressure generating chambers 21. In this embodiment, the width, in the first direction X, of the nozzle communication holes 24 gradually increases from the first openings 241 to the second openings 242, i.e., have their side surfaces along the first direction X sloped relative to the thickness direction (i.e., the direction along which the nozzle plate 29 and the channel substrate 20 are stacked).

In this embodiment, the first openings 241 are aligned along the first direction X such that the first openings 241 are located at the same position in the second direction Y.

On the other hand, the second openings 242A of the first nozzle communication holes 24A are located closer to the pressure generating chambers 21, i.e., the manifold, in the second direction Y than the first openings 241A. The second openings 242A of the first nozzle communication holes 24 are aligned along the first direction X such that the second openings 242A are located at the same position in the second direction Y.

The width of the second openings 242A of the first nozzle communication holes 24A gradually increases along the second direction Y toward the pressure generating chambers 21 such that the width of the second openings 242A increases from a width smaller than that of the pressure generating chambers 21 to a width larger than that of the pressure generating chambers 21. The width of the second openings 242B of the second nozzle communication holes 24B gradually increases along the second direction Y toward the side opposite to the pressure generating chambers 21 such that the width of the second nozzle communication holes 24B increases from a width (a width in the first direction X) smaller than that of the pressure generating chambers 21 to a width larger than that of the pressure generating chambers 21. That is, the second openings 242A and the second openings 242B are symmetric about a line along the first direction X. The expression, "the second openings 242 have a width larger than that of the pressure generating chambers 21 in the first direction X," includes an arrangement in which the second openings 242 are partially narrower than the pressure generating chambers 21.

The second openings 242A of the first nozzle communication holes 24A and the second openings 242B of the second nozzle communication holes 24B are alternately arranged along the first direction X, and are located at different positions when viewed in the second direction Y. Specifically, the second openings 242A of the first nozzle communication holes 24A communicate with the nozzle openings 28 of the first nozzle row 281A, and the second openings 242B of the second nozzle communication holes 24B communicate with the nozzle openings 28 of the second nozzle row 281B. That is, the second openings 242A of the first nozzle communication holes 24A are aligned along the first direction X, and the second openings 242B of the second nozzle communication holes 24B are aligned along the first direction X. In addition, the second openings 242A of the first nozzle communication holes 24A aligned along the first direction X and the second openings 242B of the second nozzle communication holes 24B aligned along the first direction X are located at different positions when viewed in the second direction Y. The expression, "the second openings 242A of the first nozzle communication holes 24A aligned along the first direction X and the second openings 242B of the second nozzle communication holes 24B aligned along the first direction X are located at different positions when viewed in the second direction Y," includes an arrangement in which the second openings 242A partially overlap the second openings 242B when viewed in the second direction Y. That is, in this embodiment, although the second openings 242A and the second openings 242B partially overlap the first openings 241 when viewed in the second direction Y, the second openings 242A project toward the pressure generating chambers 21 in the second direction Y, and the second openings 242B project toward the side opposite to the pressure generating chambers 21 in the second direction Y.

The positions of the nozzle openings 28 relative to the second openings 242A are the same as the positions of the nozzle openings 28 relative to the second openings 242B. That is, each of the nozzle openings 28 is located substantially at the center of an associated one of the second openings 242A and the second openings 242B in the first direction X, and the distance from the wider end of the second opening 242A to the nozzle opening 28 is approximately equal to the distance from the wider end of the second opening 242B to the nozzle opening 28 in the second direction Y.

As described above, in this embodiment, the width, in the first direction X, of the first openings 241 of the nozzle communication holes 24 is smaller than that of the pressure generating chambers 21, the width, in the first direction X, of the second openings 242 is larger than that of the pressure generating chambers 21, and the width of the second openings 242 gradually increases from a width smaller than that of the pressure generating chambers 21 to a width larger than that of the pressure generating chambers 21. In addition, the first nozzle communication holes 24A and the second nozzle communication holes 24B are symmetric about a line along the first direction X, and alternately arranged in the first direction X. In this manner, the pressure generating chambers 21 can be densely arranged, and the nozzle openings 28 can also be densely arranged in the first direction X, resulting in size reduction of the ink jet print head 1 in the first direction X. The pressure generating chambers 21 may be densely arranged. In this case, the second openings 242 of the nozzle communication holes 24 are wider (in the first direction X) than the pressure generating chambers 21, thus facilitating positioning between the nozzle openings 28 and the nozzle communication holes 24.

Figure 7:
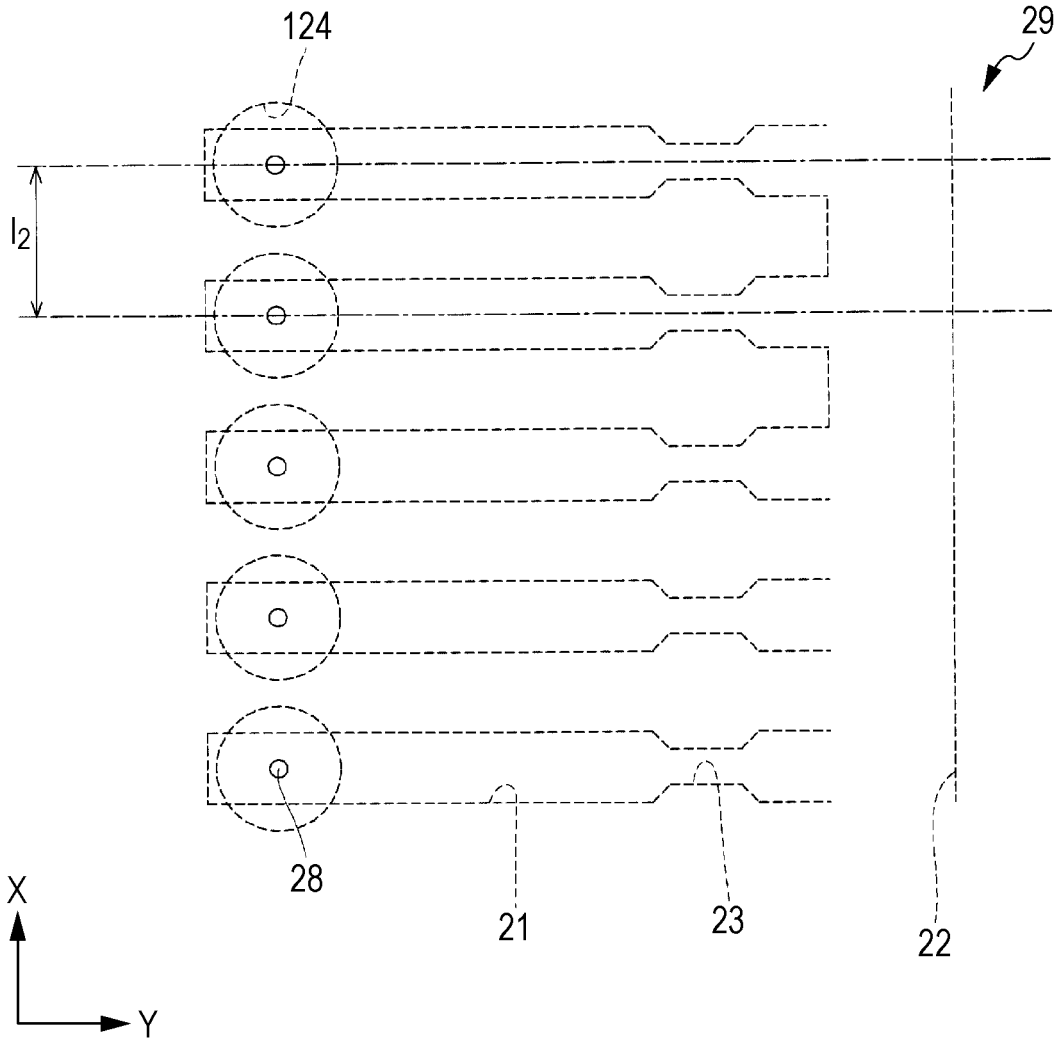
FIG. 7 is a plan view of a comparative example of the print head of the first embodiment.

In a case where nozzle communication holes 124 are vertically arranged to have the same opening area in the thickness direction as illustrated in FIG. 7, to increase the opening area of the nozzle communication holes 124 in order to facilitate positioning between the nozzle communication holes 124 and the nozzle openings 28, it is necessary to increase the width of the pressure generating chambers 21 in the first direction X or the distance between adjacent ones of the pressure generating chambers 21 in the first direction X. Thus, the pressure generating chambers 21 cannot be densely arranged in the first direction X, resulting in failure in dense arrangement of the nozzle openings 28 in the first direction X. That is, in a case where the nozzle communication holes 124 are vertically arranged to have the same opening area in the thickness direction, the distance (pitch) $l_2$ between adjacent ones of the nozzle openings 28 in the first direction X is larger than the distance $l_1$ between the nozzle openings 28 of this embodiment illustrated in FIG. 5. That is, in this embodiment, the distance $l_1$ between the nozzle openings 28 can be made smaller than the distance (pitch) $l_2$ between adjacent ones of the nozzle openings 28 in the first direction X in the case where the nozzle communication holes 124 are vertically arranged to have the same opening area in the thickness direction.

In addition, in a case where the nozzle communication holes 24 are configured such that the second openings 242 have opening areas larger than those of the first openings 241 as in this embodiment, as long as all the nozzle communication holes 24 are oriented to the same direction at the same position in the second direction Y, the width, in the first direction X, of the pressure generating chambers 21 or the distance between adjacent ones of the pressure generating chambers 21 in the first direction X needs to be increased in order to avoid interference between adjacent ones of the nozzle communication holes 24 in the first direction X. Thus, in this case, the nozzle openings 28 cannot be densely arranged in the first direction X.

On the other hand, in this embodiment, the nozzle communication holes 24 are configured such that the first openings 241 have opening areas larger than those of the second openings 242, the first nozzle communication holes 24A and the second nozzle communication holes 24B are symmetric about a line along the first direction X, and the first nozzle communication holes 24A and the second nozzle communication holes 24B are located at different positions (may partially coincide with each other) when viewed in the second direction Y. Thus, the width, in the first direction X, of the pressure generating chambers 21 does not need to be increased, and even with a small distance between adjacent ones of the pressure generating chambers 21 in the first direction X, interference between the first nozzle communication holes 24A and the second nozzle communication holes 24B can be avoided, and the nozzle openings 28 can be densely arranged in the first direction X, i.e., at the distance $l_1$ smaller than the distance $l_2$.

Furthermore, in this embodiment, the opening area of the nozzle communication holes 24 increases from the first openings 241 toward the second openings 242. Thus, the volume of the nozzle communication holes 24 is larger than that in a case where the nozzle communication holes are vertically arranged to have the same opening area in the thickness direction. Thus, ink in the nozzle communication holes 24 does not easily become viscous, and predischarge (flushing) operation of discharging ink droplets before hitting of ink droplets on an ejection target or suction operation of sucking ink through nozzle openings, for example, can be reduced, thereby reducing unnecessary consumption of ink.

Moreover, in this embodiment, the first nozzle communication holes 24A and the second nozzle communication holes 24B have symmetric shapes and are arranged at symmetric distances about a reference line extending along the first direction X and passing through the centers of the first openings 241. Thus, the distance and volume from the pressure generating chambers 21 to the nozzle openings 28 of the first nozzle row 281A are equal to those from the pressure generating chambers 21 to the nozzle openings 28 of the second nozzle row 281B. Thus, when piezoelectric actuators 31, which will be described later, cause a pressure change in the pressure generating chambers 21, the nozzle openings 28 of the first nozzle row 281A communicating with the pressure generating chambers 21 through the first nozzle communication holes 24A and the nozzle openings 28 of the second nozzle row 281B communicating with the pressure generating chambers 21 through the second nozzle communication holes 24B have the same pressure conditions and the same vibration state of a meniscus. Accordingly, discharge characteristics (e.g., velocity and weight of ink droplets) can be made uniform between ink droplets discharged from the nozzle openings 28 of the first nozzle row 281A and ink droplets discharged from the nozzle openings 28 of the second nozzle row 281B, thereby allowing ink droplets to hit an ejection target with uniform discharge characteristics.

As described above, the supply paths 23 are aligned along the first direction X such that the supply paths 23 are located at the same position in the second direction Y, and the distance and volume of the supply paths 23 are constant from the manifold 22 to the pressure generating chambers 21. This configuration can achieve uniform supply characteristics in supplying ink from the manifold 22 to the pressure generating chambers 21 through the supply paths 23. That is, ink can be supplied with uniform supply characteristics to the pressure generating chambers 21 communicating with the first nozzle row 281A and to the pressure generating chambers 21 communicating with the second nozzle row 281B. Thus, it is possible to cause ink droplets to hit an ejection target with uniform discharge characteristics by reducing a variation in discharge characteristics between ink droplets discharged from the nozzle openings 28 of the first nozzle row 281A and ink droplets discharged from the nozzle openings 28 of the second nozzle row 281B.

In the channel unit 2 including, for example, the channel substrate 20 and the nozzle plate 29 described above, the surface of the channel unit 2 in which the nozzle openings 28 of the channel unit 2 are formed is provided with a cover 6 having an exposure opening 61 where the nozzle openings 28 are exposed. The cover 6 covers the liquid ejecting surface where the nozzle openings 28 are exposed.

As illustrated in FIGS. 1-4, the vibrating board 27 is joined to the other surface of the channel substrate 20, e.g., the surface where the pressure generating chambers 21 are open, and seals the pressure generating chambers 21.

The vibrating board 27 is, for example, a composite board including an elastic film 25 of an elastic member such as a resin film and a support board 26 of, for example, a metal material supporting the elastic film 25, and the elastic film 25 is joined to the channel substrate 20. For example, in this embodiment, the elastic film 25 includes a (polyphenylene sulfide (PPS) film with a thickness of about several micrometers, and the support board 26 includes a stainless steel (SUS) board with a thickness of about several tens of micrometers.

An island portion 27*a* with which the front ends of the piezoelectric actuators 31 come in contact is provided in a region of the vibrating board 27 facing the pressure generating chambers 21. That is, the region of the vibrating board 27 facing the peripheries of the pressure generating chambers 21 has a thin portion 27*b* that is thinner than the other portion, and the island portion 27*a* is provided a the inner side of the thin portion 27*b*. The front ends of the piezoelectric actuators 31 of the actuator unit 3, which will be described later, are fixed to the island portion 27*a* with, for example, an adhesive.

In this embodiment, in a manner similar to the thin portion 27*b*, a compliance portion 27*c* that is formed by removing the support board 26 by etching and is substantially made of only an elastic film 25 is provided in a region of the vibrating board 27 facing the manifold 22. When a pressure change occurs in the manifold 22, the compliance portion 27*c* maintains a constant pressure in the manifold 22 by means of deformation of the elastic film 25 of the compliance portion 27*c* to absorb the pressure change.

In this embodiment, the vibrating board 27 includes the elastic film 25 and the support board 26, and the peripheral portion of the island portion 27*a* and the compliance portion 27*c* are substantially made of only the elastic film 25. The invention, however, is not limited to this configuration, and the island portion 27*a* and the compliance portion 27*c* may be formed by, for example, forming a recessed thin portion by partially removing, along the thickness, of a single plate member serving as a vibrating board.

As illustrated in FIG. 4, the actuator units 3 includes: a piezoelectric actuator formation member 32 in which a plurality of piezoelectric actuators 31 are aligned along the width thereof (i.e., the first direction X); and a clamp plate 34 joined to the piezoelectric actuator formation member 32 such that a front end (one end) of the piezoelectric actuator formation member 32 is a free end and a base end (the other end) of the piezoelectric actuator formation member 32 is fixed to the clamp plate 34.

The piezoelectric actuator formation member 32 is formed by laminating piezoelectric material layers that alternately sandwich inner electrodes constituting two electrodes of each of the piezoelectric actuators 31, i.e., individual inner electrodes constituting individual electrodes each electrically independent of its adjacent one of the piezoelectric actuators 31, and common inner electrodes constituting common electrodes electrically shared by adjacent ones of the piezoelectric actuators 31. In this embodiment, the piezoelectric material layers, the individual inner electrodes, and the common inner electrodes are laminated in the same direction as the plane direction of the front surfaces of the piezoelectric actuators 31, and are oriented in the second direction Y when the front surfaces of the piezoelectric actuators 31 are fixed to the island portion 27*a*.

The piezoelectric actuator formation member 32 has a plurality of slits 33 formed with, for example, a wire saw to have a comb tooth shape at the front end thereof, thereby forming a row of the piezoelectric actuators 31. At both outer sides of the row of the piezoelectric actuators 31, positioning portions 39 having a width larger than that of the piezoelectric actuators 31 are provided. Similarly to the piezoelectric actuators 31, the positioning portions 39 are included in the piezoelectric actuator formation member 32, but are non-driven vibrators that are not substantially driven. The positioning portions 39 are used for precisely positioning the actuator units 3 by coming in contact with the side surfaces of the housings 4 in the case 5 when the actuator units 3 are installed in the print head 1.

A region of the piezoelectric actuators 31 joined to the clamp plate 34 is an inactive region that does not contribute to vibration. When a voltage is applied between the individual inner electrodes and the common inner electrodes constituting the piezoelectric actuators 31, only a region at the front ends that are not joined to the clamp plate 34 vibrates. The front surfaces of the piezoelectric actuators 31 are fixed to the island portion 27*a* of the vibrating board 27 with, for example, an adhesive.

The piezoelectric actuators 31 of the actuator units 3 are coupled to a circuit substrate 100, e.g., a COF, on which a drive circuit 101, e.g., a drive IC, for driving the piezoelectric actuators 31 is mounted.

Wires (not shown) of the circuit substrate 100 are coupled, at front ends thereof, to individual outer electrodes that are located on the outer peripheries of the piezoelectric actuators 31 with, for example, solder or an anisotropic conductive material, and are electrically continuous to the individual inner electrodes and the individual outer electrodes electrically continuous to the common inner electrode, for example. This configuration allows an external driving signal to be selectively input to the piezoelectric actuators 31 through the circuit substrate 100.

The case 5 is fixed onto the vibrating board 27 of the channel substrate 20, is coupled to a liquid reservoir such as an ink cartridge not shown, and has ink inlets 51 through which ink is supplied to the manifolds 22 (see FIG. 1).

The case 5 has the two housings 4 penetrating the case 5 along the thickness direction thereof. The actuator units 3 are positioned and fixed to each of the housings 4.

As illustrated in FIG. 1, each of the housings 4 of the case 5 includes: a clamp plate holding portion 41 to which the clamp plate 34 is fixed and which has a width larger than that of the clamp plate 34; and a piezoelectric actuator holding portion 42 facing the piezoelectric actuator formation member 32 and having a width smaller than that of the clamp plate holding portion 41 and slightly larger than that of the piezoelectric actuator formation member 32. The width herein is defined along the first direction X along which the piezoelectric actuators 31 (the pressure generating chambers 21) are aligned. As illustrated in FIG. 3, the clamp plate holding portion 41 of each of the housings 4 has a stepped portion 43 such that a portion of the clamp plate holding portion 41 close to the vibrating board 27 in the penetration direction is narrower than the other portion. The clamp plate 34 is fixed to the housing 4 by bringing an end surface of the clamp plate 34 from which the piezoelectric actuators 31 project into contact with the stepped portion 43.

In this embodiment, as illustrated in FIG. 1, the two housings 4 are disposed such that the piezoelectric actuator holding portions 42 thereof face each other.

As illustrated in FIG. 3, the case 5 includes a compliance space 52 having a recessed shape that is open to the compliance portion 27*c*. The compliance space 52 holds the compliance portion 27*c* such that the compliance portion 27*c* can be deformed.

The above-referenced case 5 can be fabricated at low cost by using, for example, a resin material. Molding of the case 5 can achieve fabrication at a relatively low cost and facilitates manufacturing thereof.

In the foregoing ink jet print head 1, deformation of the piezoelectric actuators 31 and the vibrating board 27 varies the volumes of the pressure generating chambers 21, thereby discharging ink droplets through the nozzle openings 28. Specifically, when ink is supplied from the liquid reservoir such as an ink cartridge not shown to the manifold 22 through the ink inlet 51 provided in the case 5, the ink is distributed to the pressure generating chambers 21 through the supply paths 23. In actual application, a voltage is applied to the piezoelectric actuators 31 to cause the piezoelectric actuators 31 to contract. In this manner, the vibrating board 27 is deformed with the piezoelectric actuators 31 so that the volumes of the pressure generating chambers 21 increase, thereby cancelling the voltage applied to the piezoelectric actuators 31. Then, the piezoelectric actuators 31 extend to be restored, and the vibrating board 27 is also changed to the previous state. Consequently, the volumes of the pressure generating chambers 21 decrease to increase the pressure in the pressure generating chambers 21, thereby discharging ink droplets through the nozzle openings 28.

Other Embodiments

An embodiment of the invention has been described, but the basic configuration of the invention is not limited to the foregoing example.

For example, in the first embodiment, the second openings 242A of the first nozzle communication holes 24A are located closer to the pressure generating chambers 21 than the first openings 241, and the second openings 242B of the second nozzle communication holes 24B are located farther from the pressure generating chambers 21 than the first openings 241.

Figure 8:
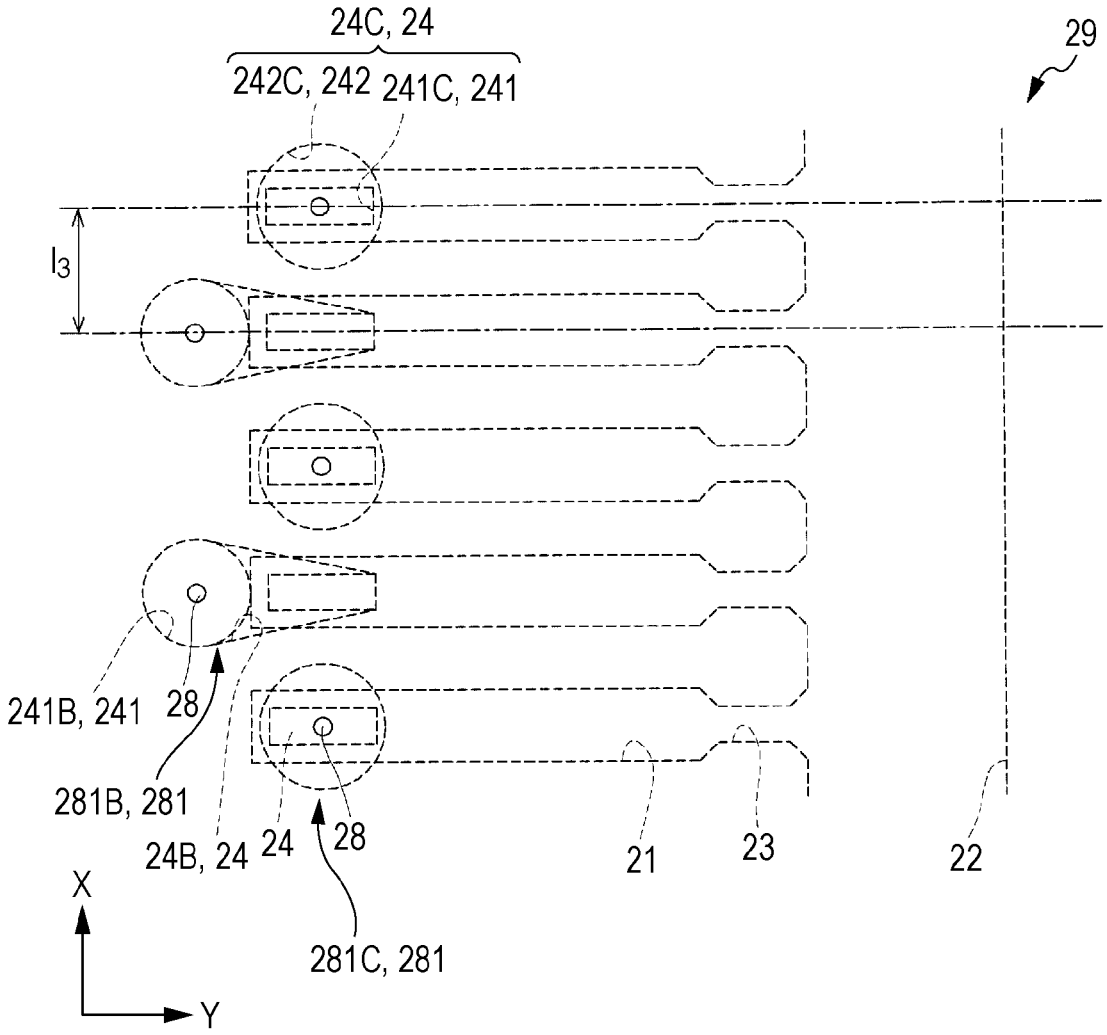
FIG. 8 is a plan view of a print head according to another embodiment of the invention.

The aspect of the invention, however, is not limited to this configuration. Another example of nozzle communication holes is illustrated in FIG. 8. FIG. 8 is a plan view illustrating another example of nozzle communication holes.

As illustrated in FIG. 8, the nozzle plate 29 includes a second nozzle row 281B of aligned nozzle openings 28 and a third nozzle row 281C of aligned nozzle openings 28.

The nozzle communication holes 24 include second nozzle communication holes 24B communicating with the nozzle openings 28 of the second nozzle row 281B and third nozzle communication holes 24C communicating with the nozzle openings 28 of the third nozzle row 281C.

The third nozzle communication holes 24C include first openings 241C communicating with the pressure generating chambers 21 and second openings 242C open to the nozzle plate 29. The second openings 242C are located at the same positions as the first openings 241C in the second direction Y, i.e., overlap each other when viewed in plan. This configuration can reduce the distance between the pressure generating chambers 21 in the second direction Y, and makes the distance $l_3$ between the nozzle openings 28 smaller than the distance $l_2$ illustrated in FIG. 7. The distance $l_3$ between the nozzle openings 28 illustrated in FIG. 8 is smaller than the distance $l_2$ illustrated in FIG. 7, but is larger than the above-referenced distance $l_1$ in the first embodiment. Thus, the configuration of the first embodiment can obtain a smaller distance between the nozzle openings 28 and a higher density in arrangement, than that of this example.

In the first embodiment, the second openings 242 are partially wider than the pressure generating chambers 21 in the first direction X, and are narrower than the pressure generating chambers 21 in another portion. The aspect of the invention is not limited to this configuration. For example, the width of all the second openings 242 may be larger than the width (in the first direction X) of the pressure generating chambers 21. In this case, as long as the second openings 242 are located at different positions from those of the first openings 241 in the second direction X, i.e., the first openings 241 and the second openings 242 do not overlap each other when viewed in plan, the first nozzle communication holes 24A and the second nozzle communication holes 24B do not interfere with each other.

In addition, in the first embodiment, piezoelectric actuators of a longitudinal vibration type that extend and contract in the axial direction by alternately laminating a piezoelectric material and an electrode material are used as pressure generators that cause a pressure change in the pressure generating chambers 21. However, pressure generators of the embodiments of the invention are not limited to this type, and may be, for example, a thin-film type in which the electrodes and piezoelectric materials are laminated by deposition or lithography, a flexural vibration type such as a thick film type formed by, for example, attachment of a green sheet. The pressure generator may be a device in which a heating element is disposed in a pressure generating chamber so that droplets are discharged through nozzle openings by means of bubbles generated by heat from the heating element, or a so-called electrostatic actuator that generates static electricity between a vibrating board and an electrode so that the vibrating board is deformed by the static electricity to discharge droplets through nozzle openings.

Figure 9:
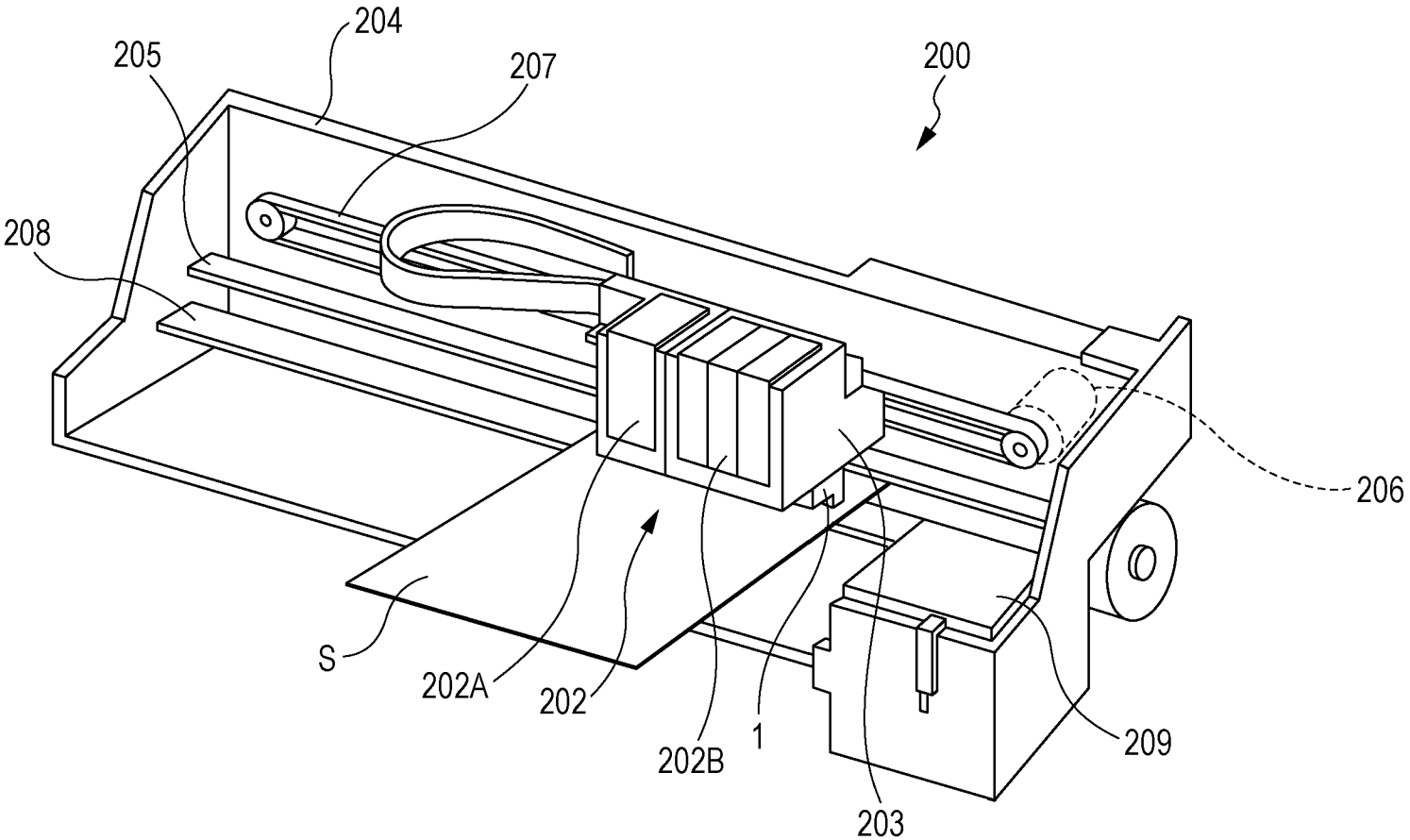
FIG. 9 is a perspective view schematically illustrating print apparatus according to an embodiment of the invention.

The above-referenced ink jet print head constitutes part of an ink jet print head unit including an ink channel communicating with, for example, an ink cartridge, and is installed in ink jet print apparatus. FIG. 9 schematically illustrates an example of the ink jet print apparatus.

In ink jet print apparatus 200 illustrated in FIG. 9, cartridges 202A and 202B constituting an ink supply unit are removably attached to an ink jet print head unit 202 (hereinafter also referred to as a head unit 202) including a plurality of ink jet print heads 1, and a carriage 203 provided with the head unit 202 is provided on a carriage shaft 205 attached to a unit body 204 such that the carriage 203 can move along the shaft 205. The head unit 202 is configured to, for example, discharge a black ink composition and a color ink composition respectively from the cartridges 202A and 202B.

A driving force of a drive motor 206 is transferred to the carriage 203 through gears, not shown, and a timing belt 207, thereby allowing the carriage 203 provided with the head unit 202 to move along the carriage shaft 205. On the other hand, the unit body 204 includes a platen 208 along the carriage shaft 205 such that a print sheet S that is a print medium such as paper supplied by, for example, sheet feed rollers not shown runs over the platen 208 and is transported.

In the ink jet print apparatus 200, the ink jet print head 1 (the head unit 202) is mounted on the carriage 203 and moves in a main scanning direction. The aspect of the invention, however, is not limited to this configuration. For example, the aspect of the invention is also applicable to so-called line-type print apparatus in which the ink jet print head 1 is fixed and printing is performed only by moving a print sheet S such as paper in a sub-scanning direction.

In the above embodiment, the ink jet print head has been described as an example of a liquid ejecting head. However, the aspect of the invention is widely applicable to general liquid ejecting heads and liquid ejecting apparatus, and of course, is applicable to liquid ejecting heads and liquid ejecting apparatus that eject liquid other than ink. Examples of other types of liquid ejecting heads include various types of print heads for use in image print apparatus such as printers, coloring material ejecting heads for use in manufacturing color filters such as liquid crystal display devices, electrode material ejecting heads for use in electrode formation of, e.g., organic EL displays and field emission displays (FED), and bio-organic compound ejecting heads for use in manufacturing biochips. The aspect of the invention is also applicable to liquid ejecting apparatus including the above-listed liquid ejecting heads.

The entire disclosure of Japanese Patent Application No. 2012-211857, filed Sep. 26, 2012 is incorporated by reference herein.

What is claimed is:

1. A liquid ejecting head comprising:

a nozzle plate in which a first nozzle row of nozzle openings aligned along a first direction and a second nozzle row of nozzle openings aligned along the first direction are disposed side by side along a second direction perpendicular to the first direction, the nozzle openings of the first nozzle row and the nozzle openings of the second nozzle row being located at different positions in the first direction; and a channel member including pressure generating chambers aligned along the first direction, supply paths that supply liquid to the pressure generating chambers, and nozzle communication holes that allows the pressure generating chambers and the nozzle openings to communicate with each other, wherein the supply paths are located at an identical position in the second direction and are aligned along the first direction, the nozzle communication holes include first openings communicating with the pressure generating chambers and second openings open to the nozzle plate, the first openings are located at an identical position in the second direction and are aligned along the first direction, the second openings have a width in the first direction larger than a width of the pressure generating chambers, the second openings aligned along the first direction alternately communicate with the first nozzle row and the second nozzle row, and the second openings are alternately arranged on different sides with respect to the first openings when viewed in the second direction.

2. The liquid ejecting head of claim 1, wherein the second openings communicating with the first nozzle row are located at positions closer to the supply paths located on a side of the pressure generating chambers than the first openings in the second direction, the second openings communicating with the second nozzle row are located at positions farther from the supply paths located on the side of the pressure generating chambers than the first openings in the second direction, and all the nozzle communication holes have constant volume and constant distance from the first openings to the second openings.

3. A liquid ejecting apparatus comprising the liquid ejecting head of claim 1.

4. A liquid ejecting apparatus comprising the liquid ejecting head of claim 2.

* * * * *